United States Patent [19]

Gondek

[11] 4,368,785

[45] Jan. 18, 1983

[54] WELL POINT AND METHOD OF DRIVING SAME

[76] Inventor: John T. Gondek, P.O. Box 21013, Minneapolis, Minn. 55421

[21] Appl. No.: 174,038

[22] Filed: Jul. 31, 1980

[51] Int. Cl.[3] ..... E21B 7/20

[52] U.S. Cl. ..... 175/21; 175/65; 175/293; 175/314

[58] Field of Search ..... 175/21, 22, 23, 65, 175/19, 314, 293

[56] References Cited

U.S. PATENT DOCUMENTS

| | | | |
|---|---|---|---|
| 216,042 | 6/1879 | Le Grand et al. | 175/19 |
| 674,191 | 5/1901 | Allen et al. | 175/19 |
| 2,257,765 | 10/1941 | Scaramucci | 166/326 |
| 2,391,828 | 12/1945 | Hood | 175/293 |
| 2,744,579 | 5/1956 | Gerhardt | 175/22 |

FOREIGN PATENT DOCUMENTS

| | | | |
|---|---|---|---|
| 613098 | 6/1978 | U.S.S.R. | 175/21 |

*Primary Examiner*—James A. Leppink
*Assistant Examiner*—Hoang C. Dang
*Attorney, Agent, or Firm*—Peterson, Palmatier, Sturm, Sjoquist & Baker, Ltd.

[57] ABSTRACT

Several embodiments of a well point are disclosed which include a resilient member that elongates each time an anvil surface near the conical tip of the well point is impacted by a drive rod. The drive rod is repeatedly raised and dropped to force the well point downwardly through the soil, pulling sections thereabove until the desired casing depth is reached.

8 Claims, 7 Drawing Figures

WELL POINT AND METHOD OF DRIVING SAME

BACKGROUND OF THE INVENTION

1. Field of the Invention

This invention relates generally to the sinking or installation of tubular well casings, and pertains more particularly to a well point and method of using same.

2. Description of the Prior Art

Well points, of course, are old and well known. Those with which I am familiar include a steel head with a conical or tapered tip at the bottom and a cylindrical screen thereabove. The upper end of the screen is threadedly attached to the first pipe section of the ultimate casing and the upper end of the first pipe section has a threaded drive cap temporarily screwed thereon. By means of a drive hammer the drive cap is repeatedly struck so as to drive the first pipe section and the well point attached to its lower end downwardly into the ground. When the next pipe section is to be added, the drive cap is removed and the next pipe section threadedly coupled to the first pipe section. The next or second pipe section is then driven downwardly and the action continued to form a well casing on the order of thirty feet or so under normal soil conditions, the length depending upon the depth of the water table to be reached. While the individual pipe sections can vary in length, they are customarily on the order of five feet in length.

Consequently, it can be appreciated that a sizable number of pipe sections must be coupled together to form the well casing and that it can become quite long. Because the column of pipe sections constituting the well casing is struck at its upper end, which upper end becomes increasingly more remote from the drill point at the bottom of the casing as more and more pipe sections are added, it follows that as the casing gets longer and longer, the casing progressively absorbs more and more of the blow due to its greater inertia plus the fact that the column compresses from the impact. Thus, the resultant force applied to the well point, which is at the lower end of the casing receives a smaller and smaller proportion of the hammer blow being applied at the casing's upper end. This can seriously limit the depth to which the casing or column can be driven. Also, the rather lengthy column of pipe sections can buckle or bow, the buckling or bowing becoming more pronounced when the soil formation is compacted, nonporous or rocky. A specific situation that frequently arises is that the well point may pass through, said, twenty feet of soft soil, then encountering a hard soil condition which must be penetrated by first transmitting the hammer blows through the rather massive twenty foot string of pipe sections before they reach the well point. Furthermore, inasmuch as the column is struck at its upper end, the well point is apt to "wander", the degree of wandering becoming greater and greater as the column lengthens; if the soil is hard and rocky, the well point is even more vulnerable to being deflected as it advances downwardly.

SUMMARY OF THE INVENTION

An important object of my invention is to provide a means for driving a well point to virtually an unlimited depth. More specifically, an aim of the invention is to deliver the impact blow at a location adjacent the lower end of the well point, thereby utilizing each blow to its fullest extent in causing the well point to penetrate the soil without having the impact absorbed by the pipe casing as happens when hammer blows are applied at the top of the casing.

Another object of the invention is to produce a column of pipe sections that is straighter or more vertical than in the past. By pulling the pipe sections downwardly, they can be driven in a straighter and more vertical path than when subjected to compressive forces only at the top, as in the past.

Another object is to install a well casing composed of standard pipe sections in contradistinction to heavy pipe sections, as in the past. It is within the purview of my invention to use plastic pipe sections rather than metal ones.

Inasmuch as perforated cylindrical screens are associated with well points, they have had to be quite rugged with their holes sufficiently spaced so as not to weaken the wall to such an extent that the compressive drive forces being transmitted downwardly to the well point do not distort the screen portion of the well point.

Still another object is to install a well casing in less time than heretofore.

Yet another object of the invention is to provide a well point in which a jet or liquid can be employed which loosens the subsurface soil as the well point is driven downwardly.

Briefly, my invention contemplates the use of a well point when sinking a well casing composed of a number of pipe sections that provide an anvil surface or portion near the conical tip that is progressively penetrating the soil, the anvil surface being repeatedly impacted by a drive rod to force the well point farther and farther into the ground. The drive rod is repeatedly raised and dropped (or forced down) so as to apply an impact force to the well point at a location where a large proportion of the impact force will not be absorbed by the pipe above the well point. Since the impact forces are applied adjacent the pointed end or tapered tip of the well point, the well point is driven in a more vertical line than heretofore, even when hard, nonporous and rocky soil formations are encountered. Still further, my invention enables a jet of water to be readily applied in the region of the conical tip or point so as to appreciably loosen and lubricate the soil, thereby permitting the well point to be driven not only in a truer axial direction but also at a faster rate than heretofore. Still further, my invention includes a novel check valve system permitting water to be jetted out of the point but preventing external water from entering these ports, thus eliminating the costly closure methods now employed.

Consequently, my invention basically contemplates the impacting of a well point at an optimum location so as to avoid transmitting the driving forces downwardly through the pipe sections above the well point where they are unduly absorbed due to the mass of such pipe sections. While the well point can be fabricated with a sufficient inherent resiliency, several embodiments have been devised with special resilient members therein which enable the well point to be driven downwardly at a relatively rapid rate without dissipating or losing a substantial percentage of the blows due to inertia of the pipe above the point.

DESCRIPTION OF THE PREFERRED EMBODIMENTS

Figure 1:
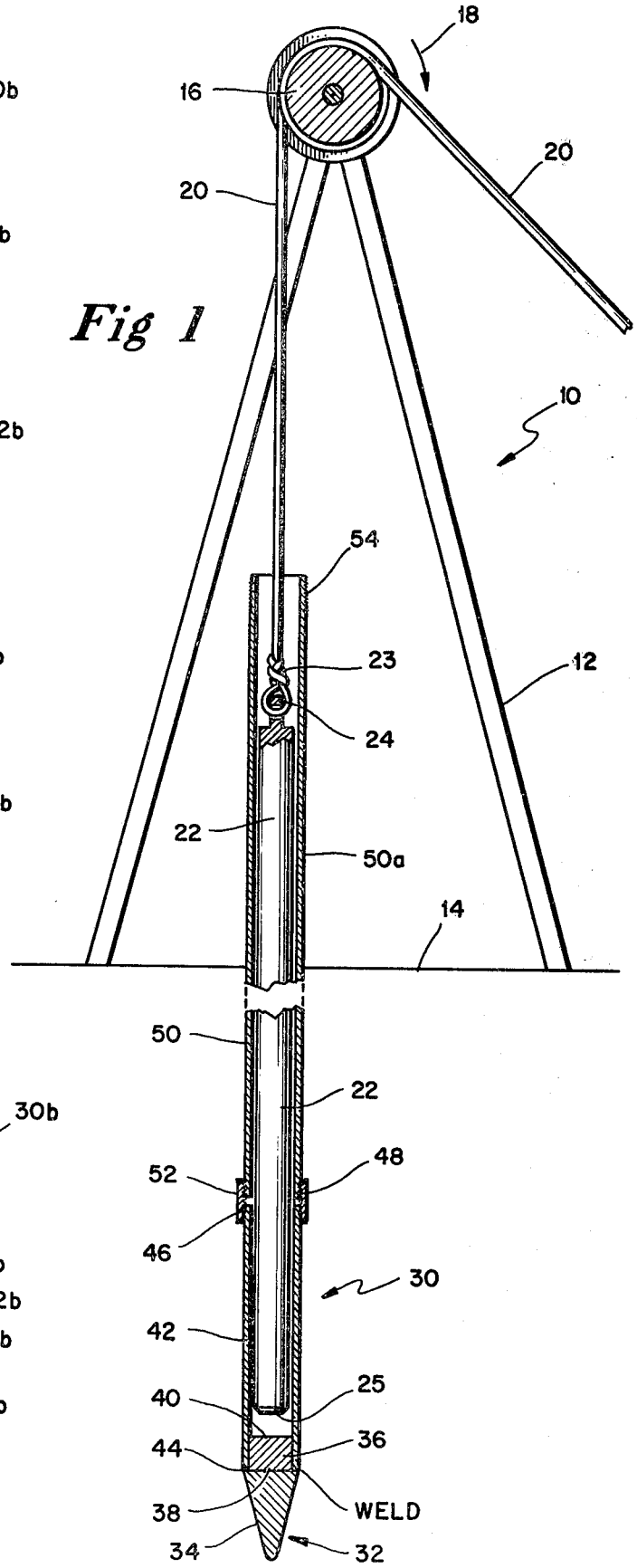
FIG. 1 is an elevational view of a conventional ground-supported rig with a simple well point being driven thereby, the well point and the pipe section thereabove exemplifying my method appearing in cross section.

Referring first to FIG. 1, a conventional rig indicated generally by the reference numeral 10 has been pictured in order to illustrate how my invention is practiced.

The rig 10 includes a tripod having its legs 12 resting on the ground surface labeled 14, the tripod rotatably supporting at its upper end a drum 16. The drum 16 is rotated by a motor (not shown) in the direction of the arrow 18. A length of rope 20 having an overall length at least equal to the depth of the well to be sunk is enwrapped or looped once about the drum. While one end of the rope 20 is hand held, the other end of the rope is attached to the upper end 21 of a drive rod 22, such as by a knot 23 connected to an eye 24 integral with the upper end 21 of the drive rod 22. The drive rod 22 has a lower end denoted by the numeral 25.

It might be helpful at the outset to explain that the relatively heavy drive rod 22 is repeatedly raised and dropped by simply pulling on the end of the rope 20 held in the operator's hands (not shown). Owing to the single turn of rope 20 encircling the drum 16, the encircling turn becomes tight and the gripping thereof against the cylindrical surface of the drum 16 will cause the drum, because it rotates in the direction of the arrow 18, to raise the drive rod 22. When raised sufficiently, the operator relaxes his grip or hold on the rope 20 with the consequence that the drive rod gravitationally falls. Other apparatus than the rig 10 can be used for reciprocating the drive rod 22 up and down. Thus, while the drive rod 22 plays an important role in the practicing of my invention, the rig denoted generally by the reference numeral 10 is susceptible to modification or replacement by other equipment.

Describing now the well point shown in FIG. 1, it will be observed that the well point has been denoted in its entirety by the reference numeral 30. This well point 30 comprises a head 32 of steel formed with a downwardly directed conical or tapered tip 34 and an upwardly directed cylindrical boss 36, the boss 36 being of reduced diameter so as to form an annular shoulder 38. The upper end of the boss 36 provides an anvil surface or portion 40 serving a purpose presently to be explained.

The cylindrical boss 36 is telescopically received in the lower end of a cylindrical steel tube 42. The tube 42 is inherently resilient to the degree that it is capable of being elongated or expanded when the anvil surface or portion 40 is struck with a sufficient driving force, as will become apparent below. The head 32 is fixedly secured to the tube 42 by means of a circumferential bead or seam weld at 44. Thus, the head 32 and steel tube 42 comprise the unitary or integral well point 30.

Whereas the lower end of the steel tube 42 is welded to the head 32 at 44, the upper end of the tube 42 has threads 46. In this way the well point 30 can be readily attached to the lower threaded end 48 of a first wrought iron pipe section 50 (or it can be a plastic tube) by means of a suitable pipe coupling 52. The pipe section 50 has another set of threads at its upper end so that a second pipe section 50 can be connected or attached by another coupling 52, the threads at the upper end of the lower pipe section 50 corresponding to the threads 54 at the upper end of the second section 50. The column of pipe sections 50 will form the final well casing having an overall length such that the water table at whatever depth it happens to be will be reached by the well point 30. Thus, it will be appreciated that the showing of just portions of only two pipe sections 50 in FIG. 1 has been prompted by the scale; any number of pipe sections 50 can be employed in order to reach the water table. Also, to keep FIG. 1 as simple as possible, the screen through which the well water enters the well casing has been omitted.

Figure 2:
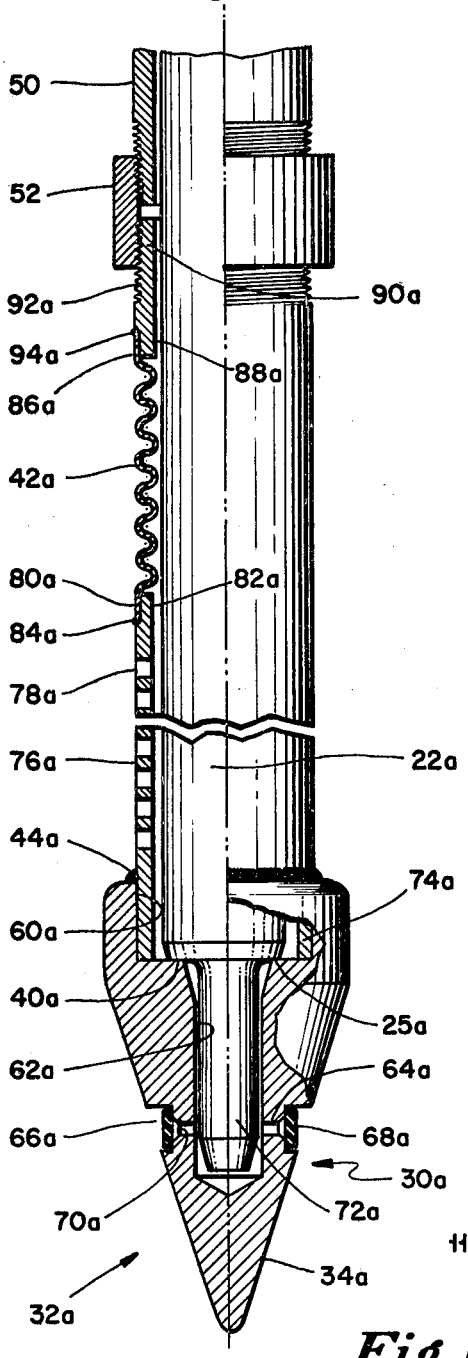
FIG. 2 is an enlarged sectional view of a well point in accordance with my invention, the well point in this instance employing a resilient bellows.

Before describing the embodiment of FIG. 2, it will be well to refer to the operation or installation procedure that is employed with respect to the well point 30 just described. When initiating a well drilling or sinking operation, the first pipe section 50 is threadedly connected to the well point 30 by means of the coupling 52. After first boring or digging a shallow hole in the surface 14 where the well is to be sunk and with the conical tip 34 of the well point 30 disposed in the shallow hole, then the drive rod 22 is inserted through the upper end of the first pipe section 50 and is permitted to drop gravitationally downwardly so that its lower end 25 strikes the anvil surface or portion 40. Only a few impact blows are necessary to cause the conical tip 34 to penetrate the ground and continued blows will drive the well point 30 downwardly through the soil formation beneath the surface 14. Since the impacting is performed near the conical tip 34, it follows that the pipe section 50 is put under tension each time that a blow is delivered from the rod 22 to the anvil portion 40. Each time the anvil portion 40 is struck, the tube 42 is stretched or elongated somewhat. Depending on the type of material used in fabricating the tube 42, and of course the severity of the blow delivered by the drive rod 22, the tube 42, when of steel, may only elongate on the order of 0.008 inch/linear foot; when plastic is used the tube elongates a much greater amount.

Consequently, the first pipe section 50 is pulled downwardly under tension. This is just the opposite of the technique heretofore used in which the drive cap is screwed to the upper end of the first pipe section. As the well point 30 is driven down as a result of successive impact blows being applied from the drive rod 22 to the anvil portion 40, a second pipe section 50 is coupled to the first pipe section 50 by means of another coupling 52. As the well point 30 is driven farther and farther into the ground, additional pipe sections 50 (not shown) are successively coupled together, additional couplings 52 being used to effect the threaded connection thereof.

It should be recognized that the tip 34 of the head 32, being impacted adjacent thereto, follows a straight course—at least a more vertical path than heretofore—because when the pipe sections 50 are impacted at the upper end thereof, as in the past, the pipe sections compress, increasingly absorbing most of the blow as the casing increases in length. Also, the resulting column or string of pipe sections forming the well casing have tended to bow and buckle. Still further, when blows are applied to the upper end of the uppermost pipe section and when the conical tip under such conditions in the past strikes a rock or an extremely hard subsoil formation, it can be more readily deflected so as to wander and not follow a true downward or vertical course.

Since the capability of a cylindrical tube, such as the tube 42, to expand is somewhat limited, the invention provides for a greater amount of elongation to occur for the same magnitude of impact force. Therefore, attention is now directed to FIG. 2 where a modified well point 30*a* has been illustrated making use of an accordian-like bellows 42*a*, preferably of steel and the corrugations of which more effectively allow the bellows to expand or lengthen. More will be said presently with respect to the way in which the bellows 42*a* is incorporated into the well point 30*a*.

At this time, though, it is to be noted that the head 32*a* has a recess 60*a* which extends downwardly to form an anvil surface or portion 40*a*. Actually the anvil portion 40*a* is in the form of an annular shoulder.

Centrally located and extending vertically downwardly from the anvil surface or portion 40*a* is a passage labeled 62*a*. Whereas the recess 60*a* can be formed by drilling out metal from the upper portion of the head 32*a*, the additional passage 62*a* extending downwardly therefrom can also be easily drilled. Still further, there are two or more radial passages 64*a* that are drilled inwardly from the outside of the conical or tapered tip 34*a* so as to provide communication with the lower portion of the passage 62*a*. More specifically, the passages 64*a* just mentioned extend radially inwardly from a circumferential groove 66*a* formed in the conical tip 34*a* of the head 32*a*. Residing in the circumferential groove 66*a* is an elastic band or ring 68*a* that normally closes the outer or discharge ports 70*a* of the radial passages 64*a*.

In the embodiment of FIG. 2, the drive rod 22*a* has a piston 72 projecting downwardly from its lower end 25*a*, the piston 72 being reciprocable in the passage 62*a* when the drive rod 22*a* is raised and lowered.

Having its lower imperforate end 74*a* received within the recess is a cylindrical screen 76*a*. The screen 76*a* is secured to the head 32*a* by a weld at 44*a*. The screen 76*a* has a number of holes or perforations 78*a* formed therein. As the description progresses, it will be appreciated that the holes or perforations 78*a* enable the well water to enter from the outside into the interior of the screen 76*a* and is then pumped upwardly through the well casing comprised of the various pipe sections 50.

At this stage, though, attention is again directed to the flexible bellows 42*a*, the cylindrical lower end portion 80*a* of which encircles a reduced diameter end portion 82*a* integral with the upper end of the screen 76*a*. In other words, the end portion 82*a* on the upper end of the screen 76*a* is telescopically received within the lower cylindrical end portion 80*a* of the bellows 42*a*. The bellows 42*a* is fixedly attached to the screen 76*a* by means of a weld at 84*a*. In a somewhat similar fashion, the upper cylindrical end portion 86*a* of the bellows 42*a* receives therein a reduced diameter end portion 88*a* of a bushing 90*a* having external threads 92*a*. The bushing 90*a* is welded to the bellows 42*a* by means of a circumferential weld at 94*a*. The threads 92*a* are engageable with a coupling 52 which in turn connects with a pipe section 50.

Although the drive rod 22*a* in FIG. 2 has its lower end 25*a* resting on the anvil surface or portion 40*a*, it will be appreciated that when the rod 22*a* is raised and permitted to fall, an impact blow will be transmitted by the end 25*a* to the anvil portion 40*a* in the same manner as the end 25 strikes the anvil portion 40 in FIG. 1. The bellows 42*a*, in contrast to the elongation of the tube 42, will elongate considerably more. In this case, though, the screen 76*a* has been pictured. It should be noted that its holes 78*a* do not change in size, the bellows 42*a*, which elongates or lengthens when the drive rod 22*a* strikes the anvil portion 40*a*, assuring that this does not happen. Further, the screen 76*a* could be above the bellows 42*a*.

As the well point 30*a* is being driven down as a result of the repeated blows applied from the drive rod 22*a* to the anvil portion 40*a*, water or other liquid can be poured into the upper end of the column of pipe sections 50 and flows gravitationally downwardly through the various pipe sections 50 (depending on how many at any given time have been sunk), through the flexible bellows 42*a*, through the screen 76*a* and downwardly into the relatively small diameter passage 62*a* within the head 32 of the well point 30*a*. Each time that the drive rod 22*a* is raised, the water or other liquid is permitted to enter the small diameter passage 62*a*. When the drive rod 22*a* is permitted to fall, then the piston 72*a* at its lower end enters the passage 72*a* and acts against the water so as to force it downwardly through the passage 62*a* and then outwardly through the ports 70*a* of the radial or lateral passages 64*a*. The elastic band 68*a* functions as a check valve and readily yields to permit the water or other liquid to be discharged, automatically contracting to close the ports 70*a* when the drive rod 22*a* is raised again, which it is done in preparation for delivering each successive blow. By closing the ports 70*a*, as is done by the band 68*a* when it contracts, the well water must pass through the screen 76*a*. Also, the elastic band 68*a* prevents any dirt or debris from entering the lateral passages 64*a* because the ports 70*a* thereof are blocked by the elastic band 68*a* when it contracts as it does when no liquid is being forced outwardly by the downward stroke of the piston 72*a*. The jet action of the water helps to soften and wash away the soil, thereby facilitating the downward movement of the well point 30*a*.

Figure 3:
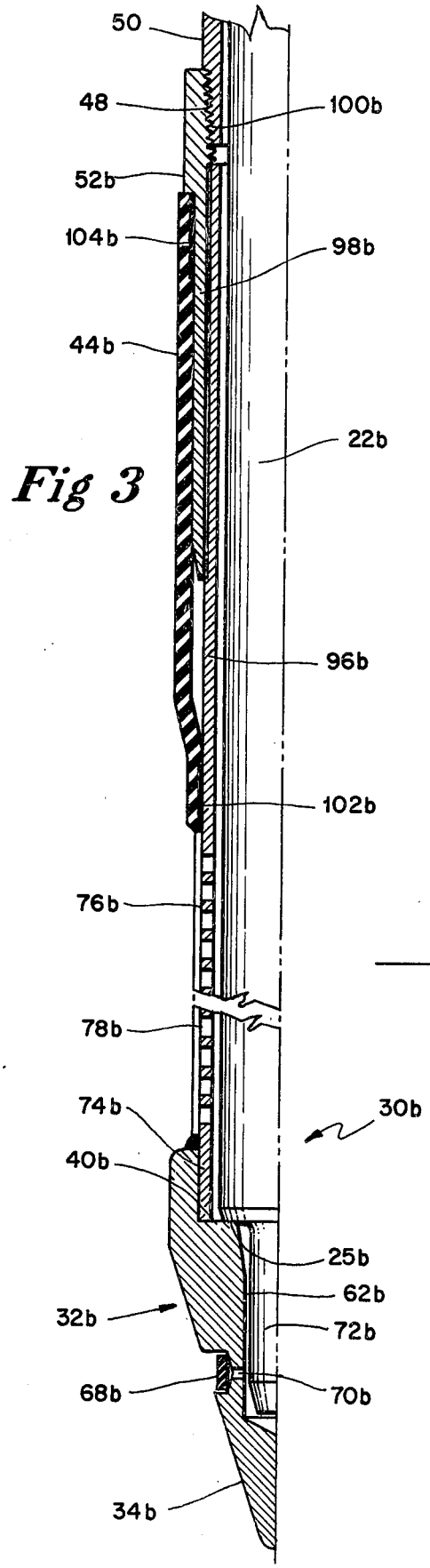
FIG. 3 is a sectional view corresponding to FIG. 2 but depicting an elastomeric sleeve as the resilient member.

Turning now to the modification appearing in FIG. 3, it will be discerned that the screen 76*b* is formed with perforations or holes 78*b* in the same manner as the screen 76*a* of FIG. 2. However, it has a rather lengthy unperforated sleeve portion 96*b* which is slidable within a cylindrical extension 98*b* of a coupling 52*b*. The coupling 52*b* has internal threads 100*b* so as to engage the threads 48 at the lower end of the first pipe section 50.

Instead of the flexible bellows 42*a*, the present embodiment makes use of an elastomeric tube 44*b*, such as polyurethane, that is adhesively bonded at 102*b* to the sleeve portion 96*b* of the screen 76*b* and at 104*b* to the cylindrical extension 98*b* of the coupling 52*b*.

In operation, which is very similar to that associated with the embodiment of FIG. 2, the drive rod 22*b* impinges or impacts against the anvil portion 40*b* to drive the well point 30*b* downwardly. Since the sleeve portion 96*b* of the screen 76*b* is free to slide within the extension 96, it follows that the elastomeric tube 44*b* is stretched approximately a total of $\frac{5}{8}$ inch each time an impact blow is delivered to the anvil portion 40*b* by means of the downward movement of drive rod 22*b*, more specifically by the impact of its end 25*b* against the portion 40*b*. The elongation of the tube 44*b* allows almost the full impact of the rod 22*b* to be delivered to the well point 30*b*, avoiding absorption of the impact by whatever pipe sections 50 have been included in the casing. It must be borne in mind that the elastomeric tube 44*b* is secured at its lower end to the sleeve portion 96*b* of the screen 76*b* and at its upper end to the cylindrical extension 98*b* of the coupling 52*b* which in turn is connected to the lower end of the first pipe section 50.

As the well point 30*b* is driven downwardly, additional pipe sections 50 are coupled or added so as to provide the well casing when the procedure is finished. It should be appreciated, too, that the pump piston 72*b* functions to force water or other liquid out through the ports at high pressure so as to loosen the soil through which the well point 30*b* is moving, as is done in the embodiment of FIG. 2.

Figure 4:
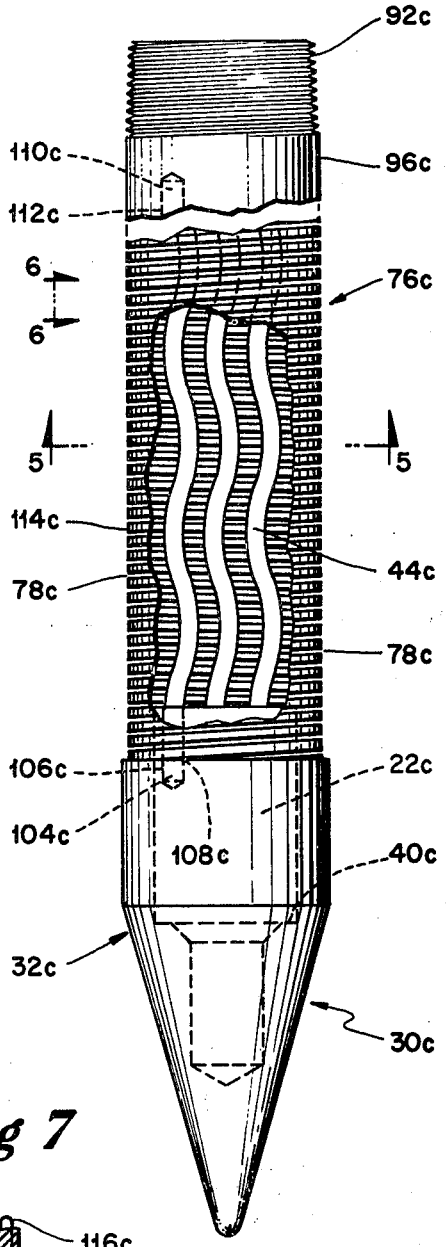
FIG. 4 represents still another embodiment of the invention, undulated rods being used in this instance.

Although the additional embodiment now to be described is somewhat more complicated and also somewhat more expensive to fabricate, nonetheless it has some decided advantages in that the resilient expansion member and the screen member are combined together as a single unit. Therefore, referring to FIG. 4, it will be seen that the head 32*c* of the well point 30*c* is the same as previously described. The means for permitting expansion or elongation of the well point 30*c* includes a number of zigzag or wavy rods 44*c* of spring material, such as steel, that can be protected from rusting by a suitable plating or copper-cladding. Although the rods can be of whatever length proves most practical for the particular well casing that is being installed, nonetheless it can be pointed out that the rods when subjected to an impact blow via the anvil portion 44*c* of the head 32*c* will stretch or elongate approximatly $\frac{3}{8}$ inch when the overall length of the well point 30*c* is approximately 30 inches.

The rods 44*c* are provided with straight lower end portions 104*c* which extend into holes 106*c* suitably drilled in the head 32*c* of the well point. Each rod 44*c* is welded to the head at 108*c*. The upper end portions 110*c* of the rods 40*c* are also preferably straight and are welded at 112*c* to a pipe nipple 96*c* having external threads 92*c* thereon which are utilized in the coupling thereof to the first pipe section 50 by means of a coupling 52.

Encircling the rods 44*c* is a screen 76*c* in the form of a stainless steel coil composed of a preferred number of wire turns or convolutions 114*c*. Preferably, each turn or convolution 114*c* is relatively close to the other so as to provide a helical slot 78*c* of restricted width, preferably on the order of from 0.005 to 0.010 inch. In this way, the coil functions as an effective screen which allows water to flow through the slot 78*c*, yet keep sand and other foreign matter from entering.

Figure 7:
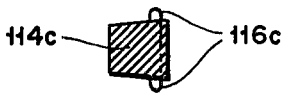
FIG. 7 is a sectional view showing the tapered cross section of one of the turns, the view being taken in the direction of line 7—7 of FIG. 6.

Describing the coil screen 76*c* in greater detail, attention is now called to FIG. 7 which shows the trapezoidal or tapered configuration of the various turns or convolutions 114*c*. It should be noted, though, that the taper is inwardly, thereby causing the coil 76*c* to function as both a screen and a filter.

Figure 6:
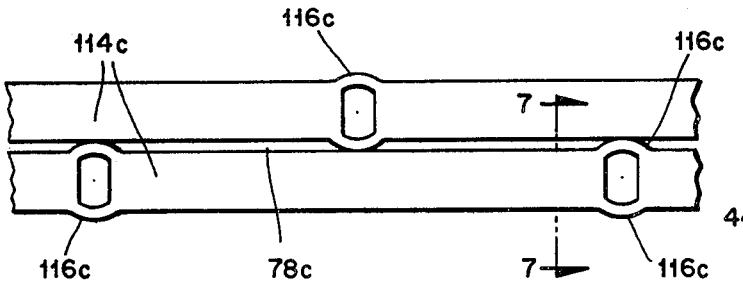
FIG. 6 is an enlarged fragmentary view in the direction of line 6—6 of FIG. 4 showing two adjacent turns of the filter coil.
Figure 5:
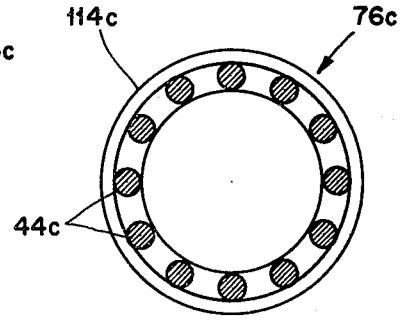
FIG. 5 is a sectional view taken in the direction of line 5—5 of FIG. 4.

In order to assure the requisite amount of spacing between the turns or convolutions 114*c* when in an unexpanded or unelongated condition, there are a number of bulges or protuberances 116*c* that bear against adjacent turns or convolutions 114*c*, these bulges 116*c* being best understood from FIG. 7, although several of them appear in FIG. 6. The bulges 116*c* assure, as just explained, that the space or slot has a preferred width, namely, approximately 0.005 to 0.010 inch.

About every six inches along the length of the rods 44*c*, the turns or convolutions 114*c* of the coil spring screen 76*c* are spot welded to the rods 44*c* to hold the rods equally spaced, although their lower ends are anchored to the head 32*c* and their upper ends to the nipple 96*c*.

From the description that has been given of the embodiment pictured in FIGS. 4–7, the manner in which it functions or operates should be readily understood. As with the earlier-described embodiments, the drive rod 22*c* simply strikes the anvil portion 40*c* to stretch or elongate the zigzag rods 44*c* and when doing so the coil spring screen 76*c* expands at the same time with the consequence that the helical slot 78*c* between adjacent turns or convolutions 114*c* enlarges, depending upon the amount of elongation or stretching of the rods 44*c*. As already mentioned, the stretching can easily be on the order of $\frac{3}{8}$ inch; this would be for a span of thirty inches. Hence, the space between each two turns or convolutions does not enlarge appreciably, but does enlarge to whatever degree is caused by the straightening of the rods 44*c* due to the impact force applied to the head 30*c*, more specifically the anvil portion 40*c* thereof. When the drive rod 22*c* is raised, then the rods 44*c* return to the original wavy or zigzag configuration. The point to be recognized is that the various rods 44*c* are straightened each time the anvil portion 40*c* and in this way the pipe sections 50 above the well point 30*c* are relieved of transmissive forces that would otherwise be absorbed because of the mass or inertia thereof. Instead, the various pipe sections 50 are continually and progressively pulled downwardly under tension as the well point 30*c* advances downwardly due to the impact forces from the drive rod 22*c*.

I claim:

1. In combination, a well point comprising a head having a downwardly extending or conical tip thereon, an upwardly facing anvil portion and a vertical passage extending partially therethrough in a downward direction into said tip, said vertical passage extending partially therethrough in a downward direction into said tip, said vertical passage beginning at the elevation of said anvil portion, and at least one passage extending generally laterally from a location adjacent the lower end of said vertical passage to form an outlet port in said tapered or conical tip for liquid introduced into said vertical passage via its upper end, said tapered or conical tip being formed with a circumferential groove containing said outlet port therein, a drive rod having a lower end for forcefully striking said anvil portion to drive said well point downwardly into the ground or soil, said drive rod having a piston extending integrally downwardly from the lower end thereof into said vertical passage for forcing liquid from said vertical passage, and an elastic band in said groove for normally closing said outlet port, said band expanding sufficiently to allow liquid to be discharged through said outlet port when sufficient pressure is developed by said piston when said drive rod is lowered.

2. A well point comprising a head having a tapered or conical tip thereon, said head being recessed to form an anvil portion near said tip, and resilient means secured to said head and extending upwardly therefrom for connection to the lower end of a first pipe section, said resilient means including a plurality of zigzag rods, whereby a drive rod striking said anvil portion will cause elongation of said resilient means and downward advancement of said head by reason of the impact forces delivered to said anvil portion.

3. The well point of claim 2 including screen means.

4. The well point of claim 3 in which said screen means includes a coil encircling said zigzag rods.

5. The well point of claim 3 in which said coil is secured to said zigzag rods at spaced locations therealong.

6. A well point comprising a head having a tapered or conical tip thereon, said head being recessed to form an anvil portion near said tip, screen means including a perforated sleeve having its lower end secured to said head, a bellows having its lower end secured to said perforated sleeve and extending upwardly therefrom for connection to the lower end of a first pipe section, whereby a drive rod striking said anvil portion will cause elongation of said bellows and downward advancement of said head by reason of the impact forces delivered to said anvil portion.

7. A well point comprising a head having a tapered or conical tip thereon, said head being recessed to form an anvil portion near said tip, screen means secured to said head and extending upwardly therefrom, said screen means having an unperforated sleeve portion continuing upwardly, and a coupling for connection to the lower end of a first pipe section, said coupling having a downwardly projecting cylindrical extension, a resilient sleeve member secured at its lower end to said unperforated sleeve portion and secured at its upper end to said downwardly projecting cylindrical extension, whereby a drive rod striking said anvil portion will cause elongation of said resilient sleeve member and cause downward advancement of said head by reason of the impact forces delivered to said anvil portion.

8. The method of sinking a well casing comprising the steps of providing a well point head having a tapered or conical tip thereon, said head having an anvil portion near said tip, resilient means secured to said head and extending upwardly to the lower end of a pipe section, the upper end of said resilient means being secured to the lower end of said pipe section, and repeatedly raising and lowering a drive rod to repeatedly strike said anvil portion to cause repeated elongations of said resilient means and incremental downward advancement of said head and said pipe section by reason of the impact forces delivered to said anvil portion by said drive rod, coupling an additional pipe section to the upper end of said first pipe section, and further repeatedly striking said anvil portion to cause further repeated elongations of said resilient means, the repeated elongations of said resilient means incrementally pulling said pipe sections downwardly under tension.

* * * * *

UNITED STATES PATENT AND TRADEMARK OFFICE

CERTIFICATE OF CORRECTION

PATENT NO. : 4,368,785

DATED : January 18, 1983

INVENTOR(S) : John T. Gondek

It is certified that error appears in the above-identified patent and that said Letters Patent are hereby corrected as shown below:

In column 7, line 1, "5/8" should be -- 3/8 --.

Signed and Sealed this

Nineteenth Day of April 1983

[SEAL]

*Attest:*

GERALD J. MOSSINGHOFF

*Attesting Officer*

*Commissioner of Patents and Trademarks*